US008382519B2

(12) United States Patent
Lin et al.

(10) Patent No.: US 8,382,519 B2
(45) Date of Patent: Feb. 26, 2013

(54) ELECTRICAL CONNECTOR FEATURED USB/ESATA INTERFACES INCORPORATED WITH ADDITIONAL POWER CONTACT

(75) Inventors: Wei-Chung Lin, Tu-Cheng (TW); Chih-Nan Lin, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 356 days.

(21) Appl. No.: 12/702,293

(22) Filed: Feb. 9, 2010

(65) Prior Publication Data

US 2010/0216340 A1 Aug. 26, 2010

(30) Foreign Application Priority Data

Feb. 23, 2009 (TW) ..... 98202633 U

(51) Int. Cl.
*H01R 13/648* (2006.01)

(52) U.S. Cl. ..... 439/607.01; 439/660

(58) Field of Classification Search ..... 439/660, 439/607.11

See application file for complete search history.

(56) References Cited

U.S. PATENT DOCUMENTS 6,666,696 B1 * 12/2003 Wu ..... 439/108
6,960,089 B2 * 11/2005 Lee et al. ..... 439/79
7,371,116 B2 5/2008 Chiang
7,611,386 B1 * 11/2009 Zhang et al. ..... 439/660
7,833,065 B2 * 11/2010 Lin et al. ..... 439/639

* cited by examiner

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

An electrical connector includes an insulative housing having a mating cavity, a tongue portion extending into the mating cavity and defining thereon first and second faces opposite to each other, and a plurality of contacts retained to the housing. The plurality of contacts defines a first and second set of contacts and expanded contacts. The first set of contacts each defines a first blade contacting section exposed onto the first face, the second set of contacts each defines a deflectable cantilevered beam exposed onto the second face, and the expanded contacts include at least one power contact for power transmission. The at least one power contact defines a second contacting section arranged between two adjacent cantilevered beams and projecting out of the second face.

20 Claims, 10 Drawing Sheets

ELECTRICAL CONNECTOR FEATURED USB/ESATA INTERFACES INCORPORATED WITH ADDITIONAL POWER CONTACT

BACKGROUND OF THE INVENTION

1. Field of the Invention

The present invention relates to an electrical connector, and more particularly to an electrical connector compatible to standards of Universal Serial Bus (USB) and External Serial Advanced Technology Attachment (eSATA) protocols having incorporated power contacts adapted to provide power supply to a device connected through the eSATA connector.

2. Description of the Related Art

Serial ATA connectors made in accordance with Serial ATA specification are widely used in desktop computers currently for transmitting signals from motherboard to HDD or transmitting power from power supply of the computer to the HDD, or transmitting signals or power between outer HDD to the computer. When the Serial ATA connectors are used in external applications, current designs usually use a single connector comprising signal and grounding contacts for signal transmission or single connector comprising power contacts for different-voltage power transmission. However, in some applications, the connector has to transmit both the signals and power, and power contacts have to be incorporated therein.

U.S. Pat. No. 7,371,116 issued to Chiang on May 13, 2008 discloses a connector socket compatible to external serial ATA (eSATA) and universal serial bus (USB) connectors has a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts mounted thereon the contact seat.

Since USB connector includes two DC terminals according to its protocol standard; computer peripherals that use the USB connector do not need extra external power. Therefore, the computer peripheral can obtain its working power after its connector is inserted into the connector socket. Due to its original protocol standard, the eSATA connector requires an external power supply to function normally. The design of an external power supply not only increases the cost of the product using the eSATA connector, it is also difficult for the product to become compact.

Therefore, it is necessary to further improve the electrical connector.

SUMMARY OF THE INVENTION

An object of the present invention is to provide an electrical connector compatible to standards of Universal Serial Bus (USB) and External Serial Advanced Technology Attachment (SATA) connectors having incorporated with power contacts adapted to provide power supply through the eSATA connectors.

In order to achieve the above-mentioned object, electrical connector includes an insulative housing having a mating cavity, a tongue portion extending into the mating cavity and defining thereon first and second faces opposite to each other, and a plurality of contacts retained to the housing. The plurality of contacts defines a first and second set of contacts and expanded contacts. The first set of contacts each defines a first blade contacting section exposed onto the first face, the second set of contacts each defines a deflectable cantilevered beam exposed onto the second face, and the expanded contacts include at least one power contact for power transmission. The at least one power contact defines a second contacting section arranged between two adjacent cantilevered beams and projecting out of the second face.

Other objects, advantages and novel features of the invention will become more apparent from the following detailed description of the present embodiment when taken in conjunction with the accompanying drawings.

DETAILED DESCRIPTION OF THE INVENTION

Figure 1:
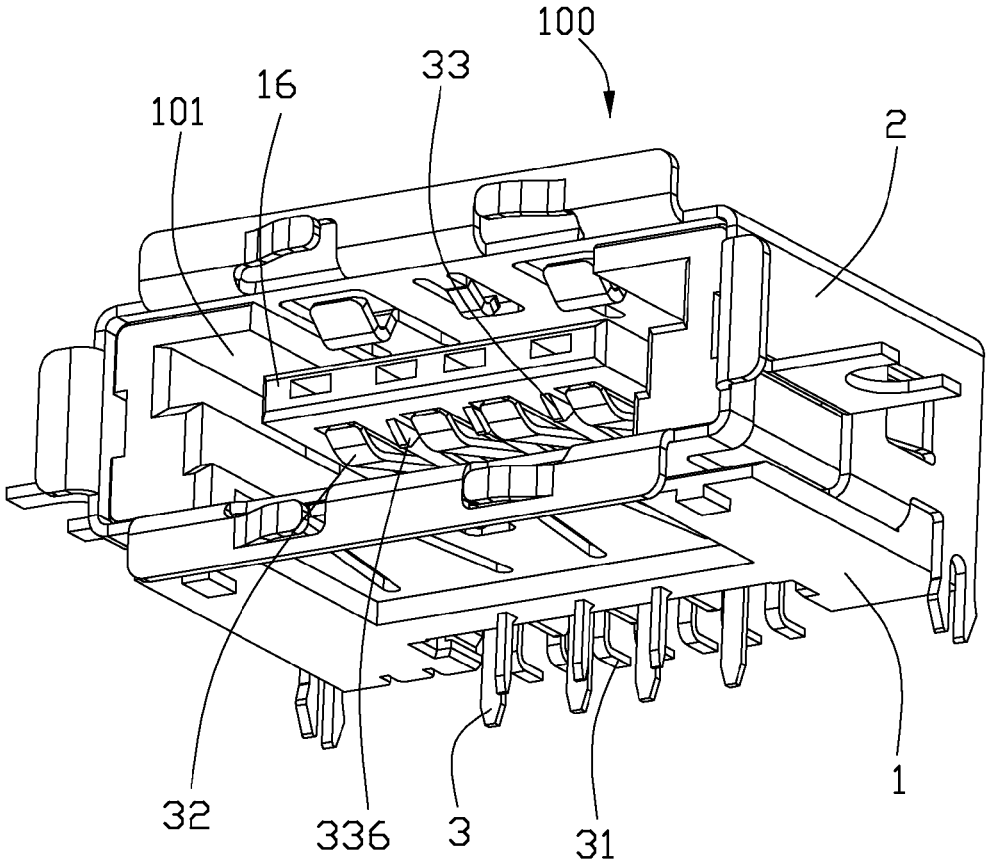
FIG. 1 is an assembled, perspective view of an electrical connector in accordance with the present invention.

Reference will now be made to the drawing figures to describe the preferred embodiments of the present invention in detail.

Figure 2:
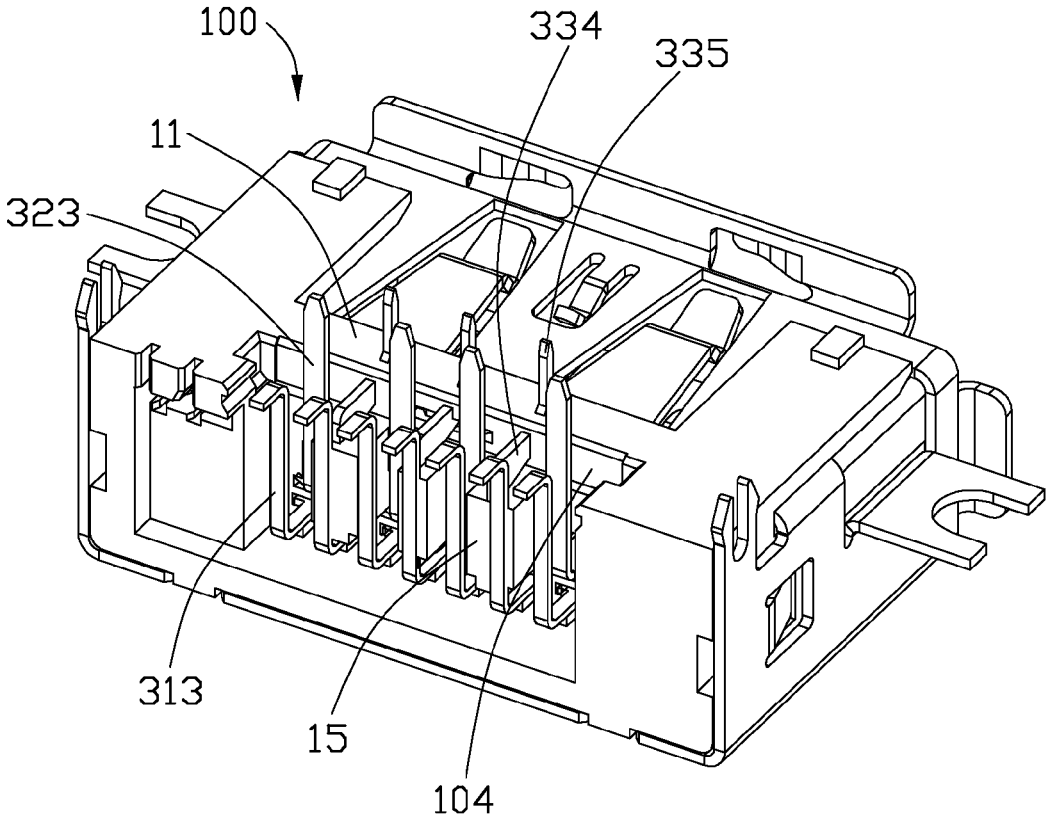
FIGS. 2 is another perspective view of the electrical connector shown in FIG. 1.

Referring to FIG. 1 and FIG. 2, disclosed here is an electrical connector 100 made in accordance with the present invention. The electrical connector 100 includes an insulative housing 1, a shielding shell 2 surrounding the housing 1 and sets contact retained to the housing 1.

Figure 5:
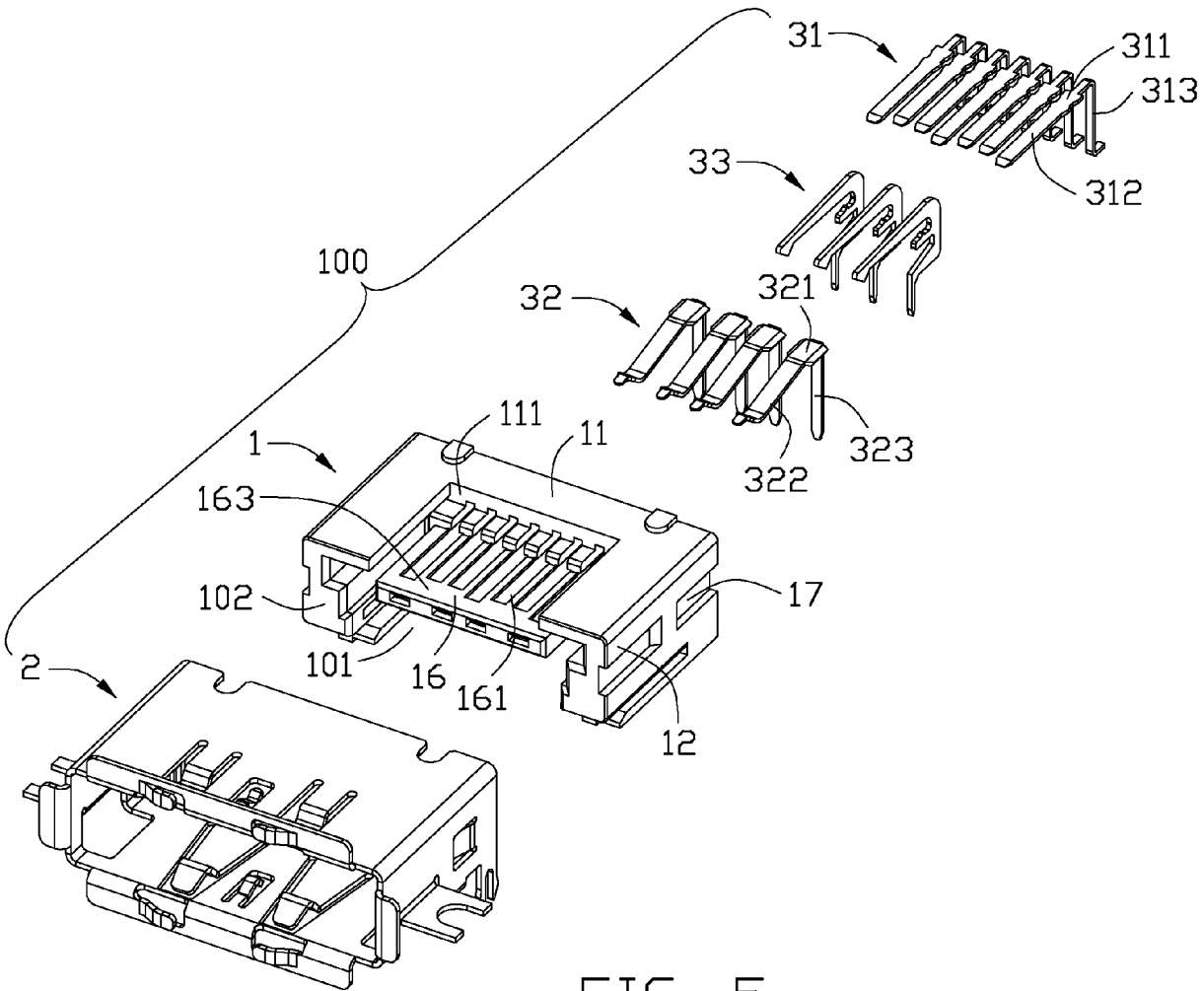
FIGS. 5-6 are two different exploded perspective views of the electrical connector of FIG. 1, showing expanded contacts separated from an insulative housing.
Figure 6:
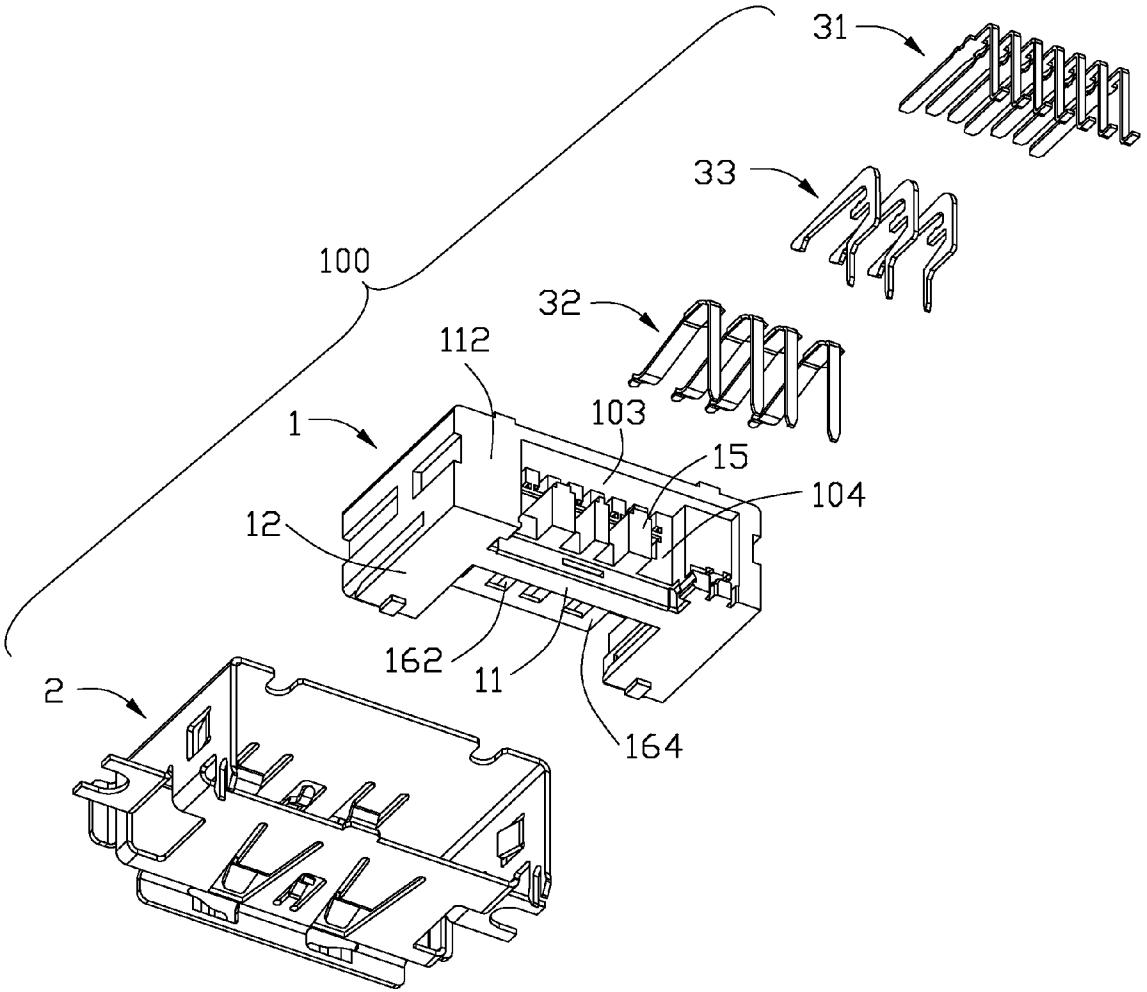
Figure 7:
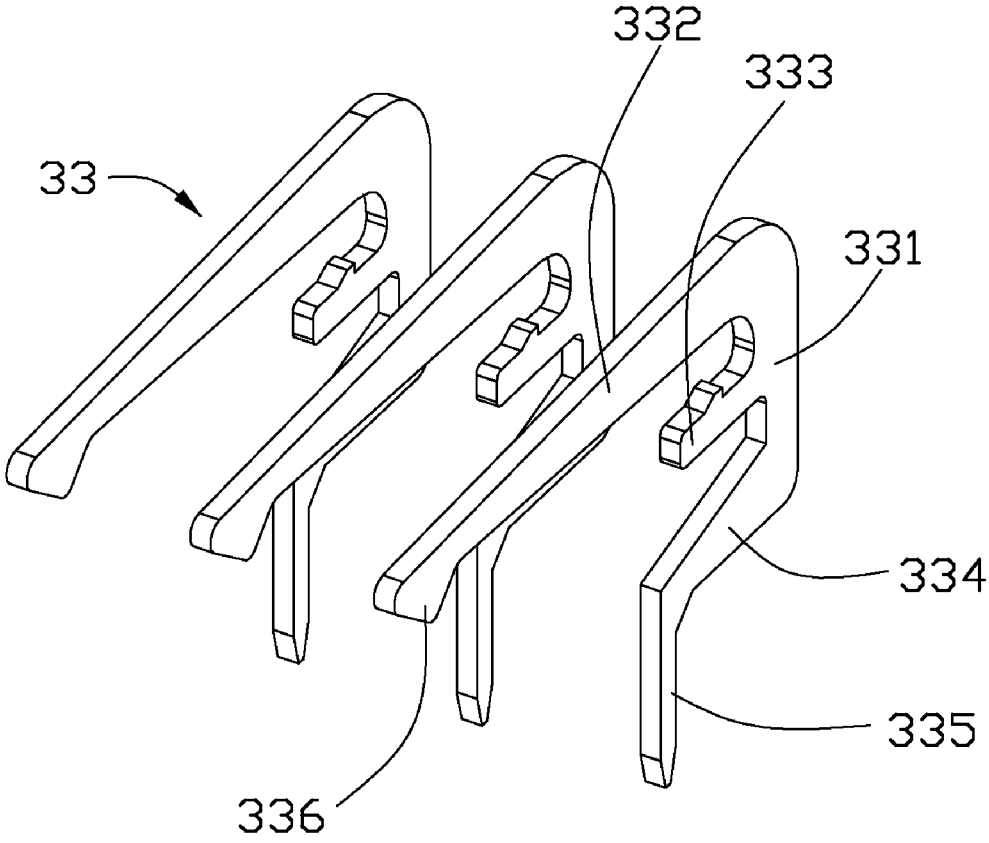
FIG. 7 is a perspective view of the extended contacts shown in FIG. 5.
Figure 8:
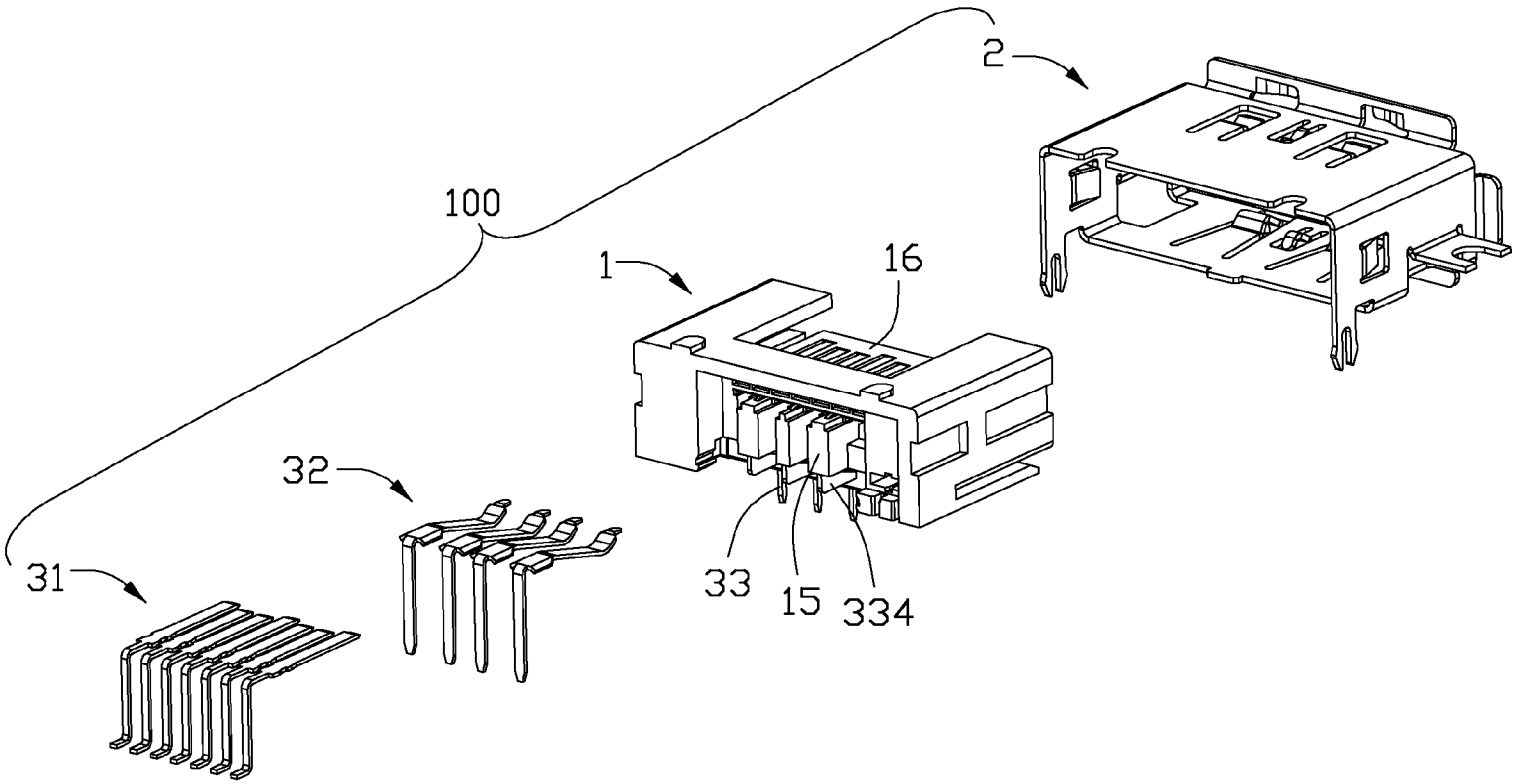
FIGS. 8-9 are two different partly exploded perspective views of the electrical connector of FIG. 1, showing the expanded contacts retained into the housing by insert molding.
Figure 9:
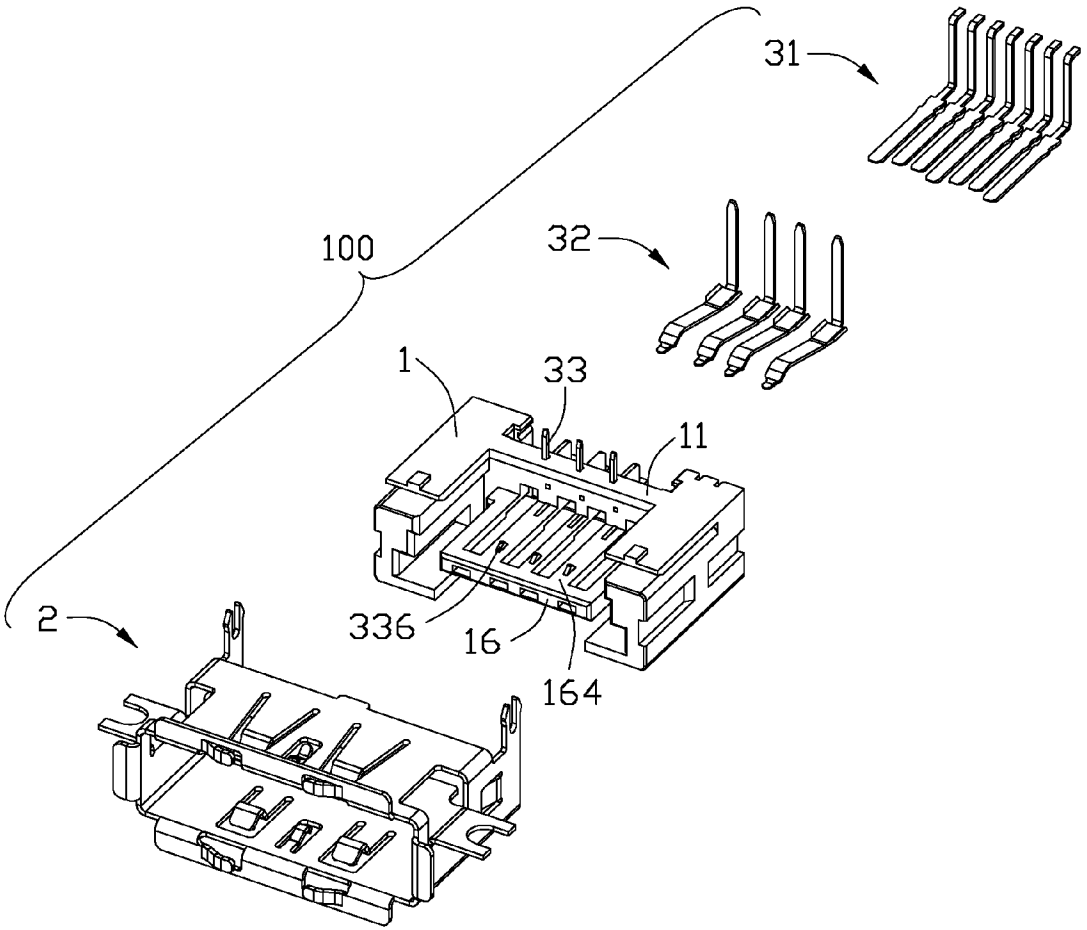
Figure 10:
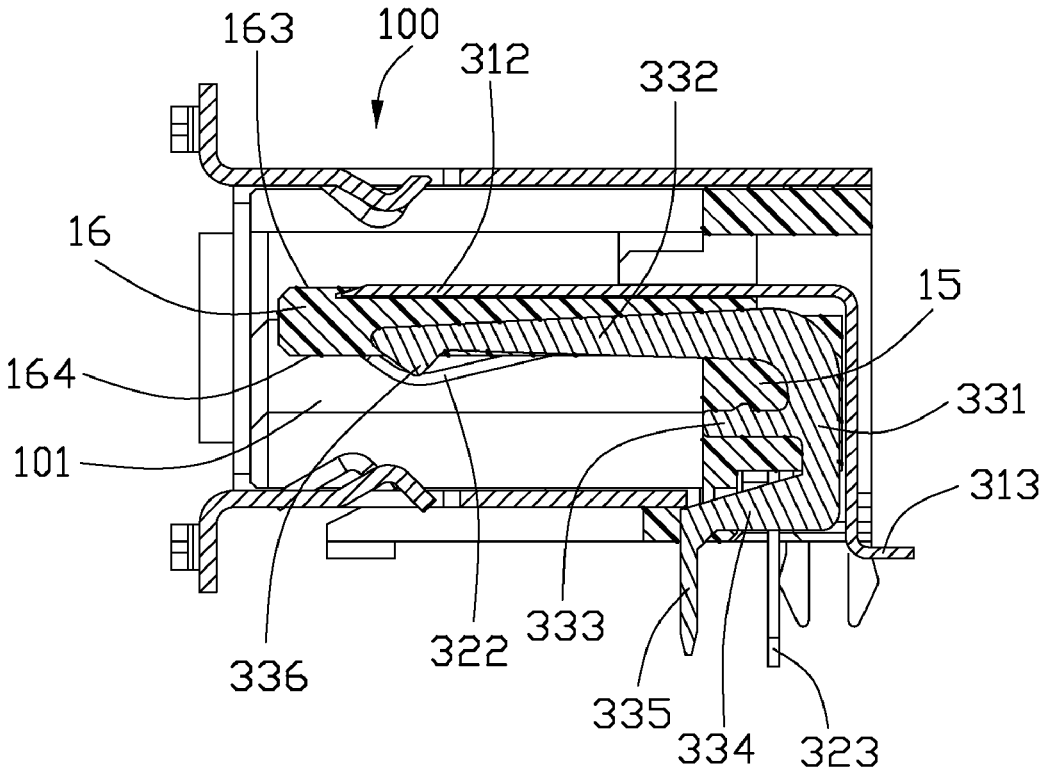
FIG. 10 is a cross sectional view taken along line 10-10 of FIG. 3.

Referring to FIG. 5 and FIG. 6, the housing 1 defines a base portion 11, a pair of front sidewalls 12 respectively extending forwards from two opposite ends of the base portion 11 and a mating cavity 101 defined by the pair of front sidewalls 12 and the base portion 11 commonly. The mating cavity 101 runs through a front end 102 of the housing 1. The base portion 11 defines a front face 111, a rear face 112 opposite to the front face 111 and a receiving cavity 103 recessed forwards from the rear face 112 and providing a stopping face 104 therein. Three protrusions 15 respectively project rearwards from the stopping face 104 and space from each other to enhance the rigidity of the housing 1. A tongue portion 16 projects forwards from the front face 111 into the mating cavity 101, which defines a plurality of passageways 161, 162 on an upper/first and a lower/second faces 163, 164 thereof for receiving the contacts thereon. The passageways 161, 162 each runs through the base portion 11, and the protrusions 15 are disposed below the tongue portion 16 and each protrusion 15 is positioned between two adjacent passageways 162 on the lower face 163 of the tongue portion 16.

Referring to FIG. 5 and FIG. 6, the contacts divide into a first set of contacts 31, totally seven eSATA contacts are included for connecting with a first complementary connector/an eSATA plug (not shown), a second set of contacts 32, totally four USB contacts are included for connecting with a second complementary connector/a USB plug (not shown), and expanded contacts 33. The first set of contacts 31 each includes a retention section 311 retained in the base portion 11, a first blade contacting section 312 extending forwards from the retention section 311 and a soldering section 313 extending rearwards and bending downwards from the retention section 311. The first contacting sections 312 are arranged in the passageways 161 on the upper face 163 of the tongue portion 16 to contact with eSATA plug, and the soldering sections 313 extend out of the base portion 11 and are received in the receiving cavity 103. The first contacting sections 312 are designated as eSATA contacting sections.

The second set of contacts 32 each includes a retention section 321, a deflectable cantilevered beam 322 forwards extending from the retention section into the mating cavity 101 and a soldering section 323 bent downwards from the retention section 321, the deflectable cantilevered beam 322 is accessible from the lower face 164 of the tongue portion 16. The cantilevered beams 322 are mating with USB 2.0 plug and are designated as USB 2.0 contacting sections.

Referring to FIG. 7 to FIG. 10, the expended contacts 33 include three contacts having the same construct, and each expended contact 33 includes a vertical main section 331, a contacting arm 332 extending forwards from an upper edge of the main section 331, a soldering section extending forwards from a lower edge of the main section 331, and a retention section 333 extending forwards from a middle portion of a front edge of the main section 331. The retention section 333 is disposed between the contacting arm 332 and the soldering section. The soldering section defines a slantwise connecting section 334 extending forwards and downwards from the lower edge of the main section 331 and a soldering leg 335 extending downwards from the front end of the connecting section 334. The expanded contacts 33 each is provided with the main section 331, the contacting arm 332, and a second contacting section 336 disposed at a free end of the contacting arm 332 and the soldering section all disposed in a same plane which is perpendicular to the first face 163 of the tongue portion 16.

Each extended contact 3 is retained into the housing 1 by insert molding, the main section 331 and the retention section 333 are fixed into the protrusion 15, and the contacting arm 332 is retained into the tongue portion 16, and the second contacting section 336 is located on the lower face 164 of the tongue portion 16 and further projects into the mating cavity 101. The connecting section 334 is disposed under the protrusion 15 with the front end retained into the base portion 11 and the soldering leg 335 extending out of the base portion 11. Referring to FIG. 1 and FIG. 2, each second contacting section 336 is arranged between two adjacent cantilevered beams 322. The soldering sections 313 of the first set of contacts 31, the soldering sections 323 of the second set of contacts 32, and the soldering legs 335 of the extended contacts 33 are respectively located in three rows from a position closest to the tongue portion 16 of the housing 1 to a position farthest from the tongue portion 16. The soldering legs 335 of the extended contacts 33 is located in a first row closest to the tongue portion 16 and spaced from the other two rows of the soldering sections 313, 323 to improve the electromagnetic interference.

Figure 3:
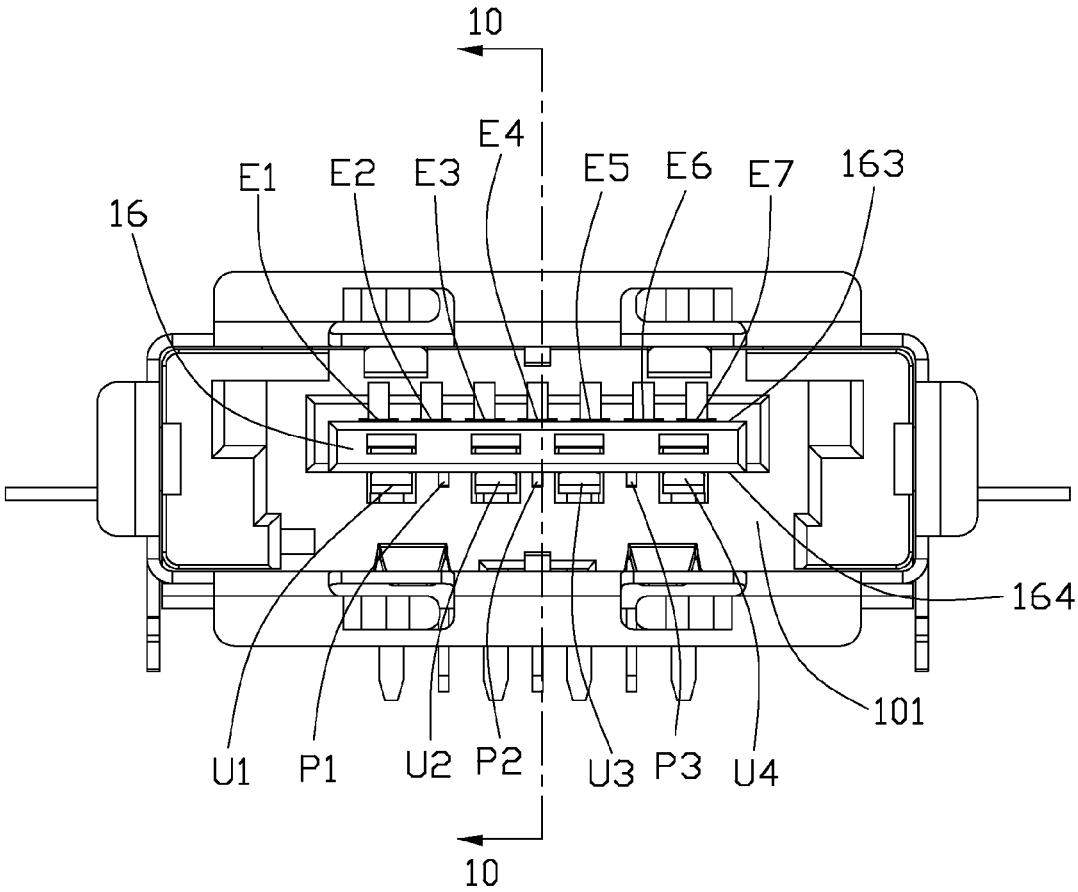
FIG. 3 is a front elevational view of the electrical connector shown in FIG. 1.
Figure 4:
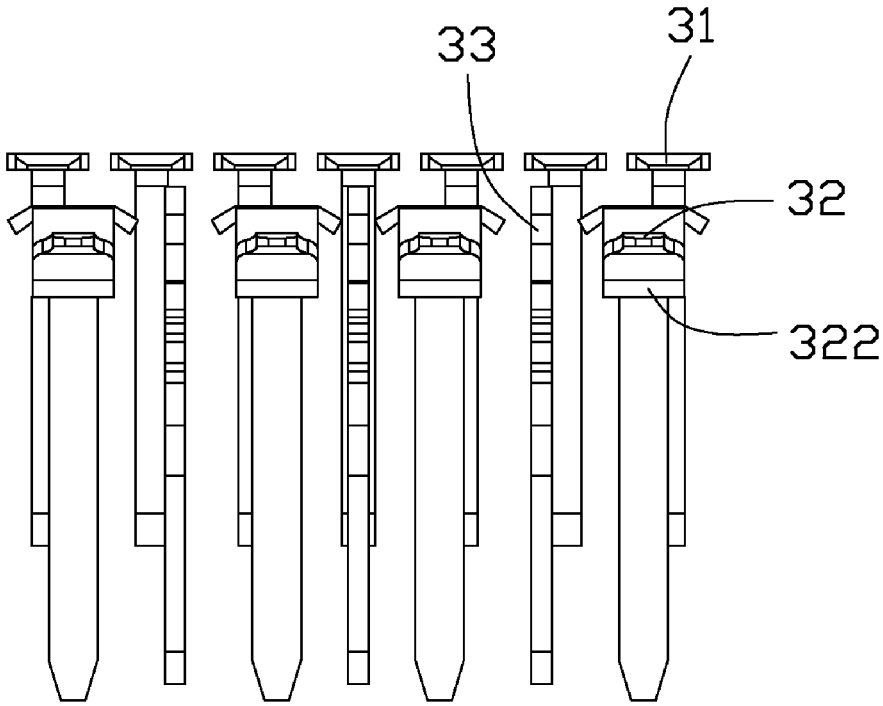
FIG. 4 is a front elevational view of the contacts shown in FIG. 3.

Referring to FIG. 3 and FIG. 4, the eSATA contact set is labeled from E1 to E7, the USB contact set is labeled from U1 to U4, and those three extended contacts 33 are labeled from P1 to P3. The extended contact P1 is disposed between the two USB contacts U1, U2 and facing to the eSATA contact E2, the extended contact P2 is disposed between the USB contacts U2, U3 and facing to the eSATA contact E4, and the extended contact P3 is disposed between the USB contacts U3, U4 and facing the eSATA contact E6.

Those seven eSATA contacts E1 to E7 include two pairs of differential pairs E2 and E3, E5 and E6 for signal transmission and three grounding pieces E1, E4 and E7 located at opposite sides of the differential pairs. The four USB contacts U1 to U4 include a pair of differential pairs U2 and U3 for signal transmission and two DC contacts U1, U4. The extended contacts P1 to P3 include at least one power contact which can provide power supply for the electrical connector while mating with an eSATA plug. In this embodiment, the extended contacts include two power contacts P1, P2 and a grounding piece P3 for the power contacts P1, P2 to ground. The two power contacts P1, P2 cooperating with the grounding piece P3 can provide two predetermined voltages, both of which are available in the existing industry and in demand by the current customers, while the electrical connector 100 mating with an eSATA plug which has counterparts corresponding to the extended contacts 33. While the electrical connector 100 mating with an eSATA plug, the extended contacts 33 are provide for power transmission, which makes the electrical connector 100 not to need extra external power supply as a convention eSATA connector. Moreover, the cost of the product using the eSATA connector is reduced and it is also easy for the product to become compact.

In other embodiments, the three extended contacts 33 can be defined as three power contacts each cooperating with a corresponding grounding pieces E1, E4 or E6 to provide three predetermined voltages, all of which are available in the existing industry and in demand by the current customers, while the electrical connector 100 mating with an eSATA plug having counterparts thereon, or the three extended contacts 33 can be defined as including one power contact P1 cooperating with a grounding piece E1, E4 or E6 for power transmission while mating with an eSATA plug which has counterparts thereon and two power contacts P2, P3 for power transmission while the electrical connector 100 mating with a USB plug with counterparts thereon. The extended contacts 33 may be not in use when the electrical connector 100 mates with a convention eSATA or USB plug without the counterparts corresponding to the extended contacts 33.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating cavity;

a tongue portion extending into the mating cavity and defining thereon first and second faces opposite to each other;

a first set of contacts each defining a first blade contacting section exposed onto the first face;

a second set of contacts each defining a deflectable cantilevered beam accessible from the second face; and expanded contacts including at least one power contact for power transmission, and the at least one power contact defining a second contacting section arranged between two adjacent cantilevered beams and projecting out of the second face; wherein the second contacting section is disposed in a plane perpendicular to the first face of the tongue portion.

2. The electrical connector as described in claim 1, wherein the at least one power contact defines a main section, a contacting arm extending forwards from an upper edge of the main section and a soldering section extending from a lower edge of the main section, the second contacting section is disposed at a free end of the contacting arm, and the main section, the contacting arm and the soldering section are all disposed in the plane in which the second contacting section is disposed.

3. The electrical connector as described in claim 2, wherein the extended contacts defines two power contacts and a grounding piece for the power contacts to ground.

4. The electrical connector as described in claim 3, wherein the two power contacts and the grounding piece have the same construct and each defines a contacting section arranged between two adjacent cantilevered beams.

5. The electrical connector as described in claim 2, wherein the first set of contacts include a plurality of signal terminals and grounding contacts, and the at least one power contact cooperates with one of the grounding contacts for power transmission.

6. The electrical connector as described in claim 5, wherein the signal contacts of the first set of contacts are arranged as differential pairs, and the grounding terminals are arranged at opposite sides of the differential pairs.

7. The electrical connector as described in claim 6, wherein the second set of contacts include a pair of differential pairs for signal transmission and two DC contacts, and the expanded contacts further include two more power contacts for power transmission while the second set of contacts connecting with a complementary connector.

8. The electrical connector as described in claim 7, wherein the expanded contacts each defines a contacting section arranged between two adjacent cantilevered beams.

9. The electrical connector as described in claim 8, wherein the expanded contacts are retained into the housing by insert molding.

10. The electrical connector as described in claim 1, wherein the first and second set of contacts each defines a soldering section, and the extended contacts each defines a soldering leg, the soldering sections of the first set of contacts, the soldering sections of the second set of contacts and the soldering legs are respectively located in three rows from a position closest to the tongue portion to a position farthest from the tongue portion.

11. The electrical connector as described in claim 10, wherein the soldering legs of the extended contacts are located in a first row closest to the tongue portion and spaced from the other two rows of the soldering sections.

12. An electrical connector compatible to standards of Universal Serial Bus (USB) and External Serial Advanced Technology Attachment (eSATA) protocols, comprising:

an insulative housing defining a mating cavity; a tongue portion extending into the mating cavity and defining thereon first and second faces opposite to each other;

an eSATA contact set comprising a plurality of signal contacts and grounding contacts arranged horizontally, and each defining a first blade contacting section exposed on the first face;

a USB contact set comprising several contacts each defining a deflectable cantilevered beam accessible from the second face; and at least one power contact comprising a deflectable second contacting section disposed between two adjacent cantilevered beams and projecting into the mating cavity for power transmission.

13. The electrical connector as described in claim 12, wherein the at least one power contact is disposed in a plane vertical to the first face of the tongue portion.

14. The electrical connector as described in claim 13, further comprising two more power contacts each having a same construct as the at least one power contact and defining a contacting section disposed between two adjacent second cantilevered beams.

15. An electrical connector comprising:

an insulative housing defining a receiving cavity with a mating tongue extending therein, said mating tongue defining opposite first and second surfaces thereon;

a plurality of first contacts disposed in the housing and defining first contact sections exposed upon the first surface with a first pitch thereof;

a plurality of second contacts disposed in the housing and defining second contacting sections exposed upon the second surface with thereof a second pitch averagely greater than the first pitch; and a plurality of third contacts disposed in the housing and defining third contacting sections exposed upon the second surface, and alternately arranged with the second contacting sections;

wherein a width of the third contacting section is smaller than both those of the first contacting section and the second contacting section under condition that the first contacts and the second contacts are made via successive forming after stamping while the third contacts are made directly via stamping; wherein said second contacting sections are configured to be deflectable during mating.

16. The electrical connector as defined in claim 15, wherein a total amount of said second contacting sections and said third contacting sections is same with that of the first contacting sections.

17. The electrical connector as claimed in claim 15, wherein said third contacts are insert molded within the housing while the first contacts and the second contacts are inserted into the housing from a rear face of the housing forwardly so as to assure sufficient strength of the mating tongue.

18. The electrical connector as claimed in claim 15, wherein said first contacts are SATA contacts, said second contacts are USB contacts and said third contacts are power contacts.

19. The electrical connector as claimed in claim 15, wherein the third contacting sections are configured to be deflectable during mating.

20. The electrical connector as claimed in claim 15, wherein the third contacting section is disposed in a vertical plane perpendicular to said first and second surfaces.

* * * * *